US009687139B2

(12) United States Patent
McKenna et al.

(10) Patent No.: US 9,687,139 B2
(45) Date of Patent: Jun. 27, 2017

(54) METHOD AND A DEVICE FOR CONTROLLED DOSING OF TREATING COMPOSITIONS IN WASHING MACHINES

(71) Applicant: Reckitt & Colman (Overseas) Limited, Berkshire (GB)

(72) Inventors: Shauna McKenna, Hull (GB); Edmund Pedley, Hull (GB); David Thomas, Devon (GB); John Wasonga, Hull (GB)

(73) Assignee: Reckitt & Colman (Overseas) Limited, Slough (GB)

( * ) Notice: Subject to any disclaimer, the term of this patent is extended or adjusted under 35 U.S.C. 154(b) by 3 days.

(21) Appl. No.: 14/356,397

(22) PCT Filed: Nov. 22, 2012

(86) PCT No.: PCT/GB2012/052892

§ 371 (c)(1),
(2) Date: May 6, 2014

(87) PCT Pub. No.: WO2013/076491

PCT Pub. Date: May 30, 2013

(65) Prior Publication Data

US 2014/0283561 A1 Sep. 25, 2014

(30) Foreign Application Priority Data

Nov. 22, 2011 (GB) ..... 1120117.5

(51) Int. Cl.

| | |
|---|---|
| ***D06F 39/02*** | (2006.01) |
| ***A47L 15/44*** | (2006.01) |
| ***A47L 15/00*** | (2006.01) |

(52) U.S. Cl.

CPC ..... *A47L 15/4463* (2013.01); *A47L 15/0055* (2013.01); *D06F 39/02* (2013.01); *D06F 39/024* (2013.01); *A47L 15/4445* (2013.01); *A47L 2401/04* (2013.01); *A47L 2401/10* (2013.01); *A47L 2501/07* (2013.01)

(58) Field of Classification Search

None

See application file for complete search history.

(56) References Cited

U.S. PATENT DOCUMENTS

| | | | | |
|---|---|---|---|---|
| 2003/0182732 | A1 | 10/2003 | Davenet et al. | |
| 2009/0235959 | A1* | 9/2009 | Gibis | A47L 15/4436 134/93 |
| 2010/0132748 | A1* | 6/2010 | Kessler | A47L 15/4454 134/93 |
| 2011/0174341 | A1* | 7/2011 | Kessler | A47L 15/006 134/93 |
| 2011/0226808 | A1 | 9/2011 | Lonski | |
| 2012/0125366 | A1* | 5/2012 | Beshears, Jr. | A47L 15/0047 134/18 |

FOREIGN PATENT DOCUMENTS

| | | | | |
|---|---|---|---|---|
| GB | 2417492 | A | 3/2006 | |
| JP | 2009136654 | A | 6/2009 | |
| WO | 2006021760 | A1 | 3/2006 | |
| WO | 2007021562 | A2 | 2/2007 | |
| WO | 2008053191 | A1 | 5/2008 | |
| WO | 2008145968 | A1 | 12/2008 | |
| WO | WO 2008145968 | A1 * | 12/2008 | A47L 15/44 |
| WO | 2011110246 | A1 | 9/2011 | |
| WO | 2011131256 | A1 | 10/2011 | |

OTHER PUBLICATIONS

International Search Report and Written Opinion dated May 10, 2013.

Combined Search and Examination Report dated Mar. 22, 2012 for the related application GB1120117.5.

* cited by examiner

*Primary Examiner* — Michael Barr
*Assistant Examiner* — Cristi Tate-Sims
(74) *Attorney, Agent, or Firm* — Troutman Sanders LLP; Ryan Schneider; Chris Davis

(57) ABSTRACT

The present invention provides a method of dispensing a plurality of treating compositions into a multistage automatic washing machine, as well as a dispensing device comprising an associated reservoir for collection of wash liquor and at least two chambers containing a treating composition. Said chambers are activated in response to an input from a sensor.

17 Claims, 1 Drawing Sheet

$$PE1 + \cancel{KE1} + \cancel{WORK1} + \cancel{FRICTION1} = PE2 + KE2 + \cancel{WORK2} + \cancel{FRICTION2}$$

METHOD AND A DEVICE FOR CONTROLLED DOSING OF TREATING COMPOSITIONS IN WASHING MACHINES

CROSS-REFERENCE TO RELATED APPLICATIONS

This application is a US National Stage of International Application No. PCT/GB2012/052892, filed 22 Nov. 2012, which claims the benefit of GB 1120117.5, filed 22 Nov. 2011, both herein fully incorporated by reference.

This invention relates to the process of using multiple detergent compositions, rinse aids, and other additives within one complete wash cycle of an automatic washing machine.

The various cleaning compositions may be dosed into the machine at varying quantities, times, sequences, and for varying durations during a washing machine cycle. The use of multiple cleaning compositions allows for increased and optimized cleaning performance.

Current conventional systems used in automatic dishwashers only dose one detergent composition per wash cycle with the optional addition of a rinse agent composition at the very end of the washing machine cycle. The detergent compositions are primarily either enzymatic based or incorporate a hypohalite oxidative bleach (e.g. sodium hypochlorite, sodium dichloroisocyanurate, etc.).

Enzymatic detergents provide excellent cleaning on enzyme sensitive soils (primarily protein and starch based) but fail to provide performance on hard to remove stains, such as coffee, tea, and tomato stains.

Hypohalite based (for example, chlorine bleach based) detergents provide excellent cleaning on the hard to remove stains but fail to provide performance on the enzyme sensitive soils. Because enzymes and hypohalite oxidizing bleaches are incompatible within the same formula matrix, the consumer must make a trade-off decision on performance and use one detergent composition or the other. This presents an obvious dilemma to the consumer—whether to get good cleaning on an enzymatic sensitive stain to the detriment of a hard to remove stain or vice versa.

The use of multiple detergent compositions within one washing machine cycle would mitigate this trade-off decision and provide optimal performance across the range of stains and soils normally encountered in an automatic dishwasher. However, given the incompatibility of enzyme based detergents and hypohalite detergents, the detergent compositions must be kept separate and dosed at different times so that the performance of each detergent is not affected by the presence of the other detergent.

BRIEF DESCRIPTION OF THE DRAWING

FIG. 1 depicts a modified Bernoulli's energy balance showing that the sum of the energy at point 2 must be equal to the sum of the starting energy at point 1.

Thus, an object of the present invention is to provide a method of dispensing a plurality of treating compositions into a multistage automatic washing machine comprising an operating device in the machine, the device comprising at least two chambers, each chamber containing a treating composition, wherein the chambers are activated in response to input from a sensor, characterized in that the device has an associated reservoir for collection of wash liquor.

A plurality of reservoirs may be present.

Another object of the present invention is to provide a device for dispensing a plurality of treating compositions into a multistage automatic washing machine comprising cartridge in the machine, the cartridge including at least two chambers, each chamber containing a treating composition, wherein the chambers are activated in response to input from a sensor, characterized in that the device has an associated reservoir for collection of wash liquor.

In a further object of the present invention there is provided a removable, automatic washing machine independent device, for dispensing a plurality of treating compositions in a multistage automatic washing machine, comprising a) a cartridge, the cartridge including at least two chambers, each chamber containing a treating composition, b) at least one sensor, wherein the chambers of the cartridge are activated in response to inputs from the at least one sensor, c) a reservoir for the collection of wash liquor in the multistage automatic washing machine, and characterised in that the sensor is located within the device such that it can monitor the wash liquor in the reservoir.

The device may have a cartridge with at least 7 chambers, preferably 10 chambers, more preferably at least 15 chambers and most preferably at least 18 chambers.

The device may be powered by battery.

The device may dispense at least two different treating compositions. For example, these may comprise a detergent and a booster agent or a detergent and a rinse aid.

Preferably the device will dispense at least three different treating compositions. Each composition may be dispensed independently based on the sensory inputs.

The device may have software to control the dispensing of the treating compositions based on the sensory inputs.

The device is ideally completely washing machine independent being able to be placed inside any commercially available washing machine.

With the use of the method and device of the invention it has been found that optimal (and highly sophisticated) device operation can be achieved. This has been speculated as being because of many factors including that (in comparison to many prior art documents) the device is able to discern phases within a machine cycle wherein the amount of wash liquor/water is low/zero, e.g. such as a drying phase. [These phases typically are indicative a change in the nature of a cycle of a machine and thus are a significant guiding feature]. Additionally when the reservoir contains a detectable level of wash liquor the parameters of said water can be measured and the right level of the right detergent may be dosed into the wash liquor. Overall the device enables intelligent dosing of detergent compositions (in terms of the total levels and the contents thereof) at various points of a wash cycle in response to the wash conditions being experienced.

Generally the reservoir is integrated into the device. As such it is preferred that the reservoir is disposed adjacent to the remainder of the device.

Preferably the sensors are disposed within the reservoir, e.g. at or near the bottom thereof. By doing this it has been found that the amount of "dead time" in which the device is unable to respond to, for example, water presence in the machine (and any attributed properties of said water) is reduced. Further, it is postulated that situating the sensors in a reservoir enables more accurate monitoring of changing parameters than could be achieved in a closed reservoir.

Preferably the sensors are in the same plane. This is useful in that each sensor is then equally exposed to the wash liquor to ensure that overall operation of the device is optimized. It is appreciated the sensors could have different sizes, thus in this regard it is meant that at least a portion of a sensing part of each sensor is preferably in or near the same plane as the remaining sensors.

Where a plurality of reservoirs are present sensors may be housed within separate reservoirs.

Preferably the reservoir fills in accordance with the following formula:

$$(V_i^{-min}-V_o^{-min})/C_{av}>H$$

Where:

$V_o^{-min}$=Volume of water lost per minute ($mm^3$)

$V_i^{-min}$=Volume of water collected per minute ($mm^3$)

$C_{av}$=average cross sectional area ($mm^2$)

H=Height from base of trough to top edge of sensor (mm)

Preferably the reservoir empties in accordance with the following formula:

$$V_o^{-min}/C_{av}>H$$

By filling/emptying in accordance with one or more of the formulae above it has been found that optimal device operation may be achieved. It is suspected that this is at least partly due to quick filling and/or emptying times, which enable speedy recognition of washing cycle start points and/or emptying/drainage points. It is these points that are often associated with the need for a release of a detergent component and/or conversely the ceasing of release of a detergent component.

Preferably (when water/wash liquor is present) the reservoir reaches a state in which it contains an amount of water/wash liquor to sense the properties of same in less than 1 minute. Preferably (when water/wash liquor is absent) the reservoir reaches a state in which it empties in less than 1 minute. This enables detection of the shortest draining periods in a wash cycle, which may be as short as 4 minutes, more likely shorter than 2 minutes, more likely shorter than 1 minute.

Most preferably then the filling/emptying time is less than 30 seconds to account for short draining cycles. In which case the formulae may be represented below:

$$(V_i^{-min}-V_o^{-min})/C_{av}>2H$$

$$V_o^{-min}/C_{av}>2H$$

The inlet (and possibly the outlet) may have a cover which aids the prevention of any soil particles, present in the wash liquor, from building up in the reservoir. Such a cover may be in the form of a net/gauze which allows wash liquor (but not suspended particles) to enter the reservoir.

The water throughput within a dishwasher may change depending on the dishwasher model and manufacturer. It is therefore necessary for the trough to be designed for the lowest throughput in order for the trough to fill within 30 seconds for all dishwasher systems.

The Bosh SGS58M02EU Logixx™ model has proved to have the lowest throughput of the different dishwashers tested. This dishwasher was therefore considered the appropriate for the experimental work to develop a design equation for the water trough.

The water trough should be designed within the specifications of the following equations in order for it to operate accurately for its desired function. The function of the water trough is for water to collect within the trough, to submerge sensors within 30 seconds. These sensors can be used for the detection of the conditions of the water within the dishwasher. Depending on the water conditions or how they change the device can follow a algorithm which decides at what stages formulation should be dispensed.

$$((5.66\times10^5-7.62\times10^3a+8.03\times10^2a^2-2.16\times10a^3+0.2a^4+41A-4.40\times10^4H+4.28\times10^2H^2+7.1\times10^5r-1.7\times10^5D+5.7\times10^4L)-([a2\sqrt{(2g^{1/2}z)}]))/C_{av}>2H$$

$$(a2\sqrt{(2g^{1/2}z)})/C_{av}>2H$$

Where:

A=the horizontal filling area, a=the angle of the collecting area h=the height of the container r=the position in the dishwasher, (r=1 at the centre, r=0 at the edge)

D=in which drawer it is placed (D=0, for the bottom drawer, D=1 for the top drawer)

$C_{av}$=average horizontal cross sectional area in $mm^2$

H=Height from the base of the reservoir to the top of sensors h=the height of the fluid within the sensor reservoir a2=the draining hole area ρ=the density of the fluid g=gravity in terms of $mm/min^2$ The Fundamentals of Creating the Equation Above:

The Mass Balance

The water trough design equation above is in essence a mass balance for the water trough, such that the inflow of water minus the outflow of water should accumulate the volume of fluid, $C_{av}$.H, in half a minute.

The general equation is:

$$(V_1^{-min}-V_o^{-min})/C_{av}>2H$$

Experimentally Creating a Formula for $V_i^{-min}$ to be Inserted into the Mass Balance In order to detail the general mass balance in terms of the parameters of the water trough, in a dishwasher system, a large amount of experimental work had to be conducted. $V_i^{-min}$, the volumetric flow into the water trough is a function of A, the angle of the collecting area, a, the horizontal area of the collecting area, h, the height of the container, r, the position within the dishwasher, D, the drawer in which it is placed and f, the filling of the dishwasher. The change in the volumetric flow due to a change in each of these parameters was determined. The data was then interpolated into a formula for the inflow of water into the device. This formula was then inserted into the mass balance.

Experimentally Creating a Formula for $V_o^{-min}$ to be Inserted into the Mass Balance $V_o^{-min}$, the volumetric flow of water out of the water trough is a function of a2: the size of the draining hole, g: acceleration due to gravity and z: the final height of the fluid after filling. Bernoulli's energy balance was therefore used to create a formula for the flow of water out of the water trough. This formula was then inserted into the mass balance.

Bernoulli's energy balance can be applied to the container. As there can be no creation or destruction of energy the sum of the energy at point 2 must be equal to the sum of the starting energy at point 1. The following equation gives the flow of fluid at the height inserted rather then the mean volumetric flow for the entirety of the draining. The mean volumetric flow is therefore determined for the upper and lower height level $V_o^{-min}$. It may be noted that as $V_o^{-min}$, is a square root function the mean of the two points will give a slightly lower value what it should be for a square root function. However this difference is considered minimum enough to be negligible.

FIG. 1 depicts the modified Bernoulli's energy balance showing that the sum of the energy at point 2 must be equal to the sum of the starting energy at point 1 as shown above. Once the crossed-out terms are removed, the equation is:

$$(PE1-PE2)=KE2$$

$$\rho gzV=\tfrac{1}{2}\rho v^2V$$

$$v=\sqrt{(2gz)}$$

$$V_o^{-min}=a2\sqrt{(2g\tfrac{1}{2}z)}$$

$$V_o^{-min}=a2\sqrt{(2g\tfrac{1}{2}z)}$$

Where:
PE=potential energy
KE=Kinetic energy
1=position 1
2=position 2
ρ=the density of the fluid
$V_o^{-min}1$=the volumetric flow at point 1
$V_o^{-min}2$=the volumetric flow at point 2
g=gravity 9.81 m/s$^2$
a2=the area of the draining hole
a3=the area of the volumetric fluid flow out of the container
z=the height from point 1 to point 2
½z=the mean height of the fluid during the filling process.
Assumptions:

1. Considering quasi-static state where the draining of the main cup volume is approximately equal to 0 on a short time period dt.
2. Considering friction to be negligible. This is the friction associated with sear force at the containers edge and turbulence.
3. Considering the correction factor for a3, area of the volumetric outflow of fluid to be negligible and therefore a3 to be approximately equal to a2.

It is important to note that the above equations and assumptions are not limiting to the present invention. They are provided as an example of how to calculate the required parameters of the collection reservoir for optimum performance. The skilled person will be able to vary the equations (or provide their own) above to derive the time for drainage that is desired.

The Assumptions and Methods Used to Create the Formulae $$V_i^{-min}=f(A,a,h,r,D,f)$$

Where:
$V_i^{min}$=The inflow of water into the water trough $V_i^{-min}$, the volumetric flow of water into the water trough is a function of A: the angle of the collecting area, a: the horizontal area of the collecting area, h: the height of the container, r: the position within the dishwasher, D: the drawer in which it is placed and f: the filling of the dishwasher.

Each of these parameters were assumed independent of each other in the testing.

The Bosh Logixx™ SGS58MO2EU dishwasher was tested to have the lowest through-put of the dishwashers available and was therefore considered to be the most appropriate machine to perform the testing. This is because the dishwasher with the lowest throughput will have the lowest rate of accumulation of water and therefore the water trough should be designed for this dishwasher in order for the filling conditions to be appropriate for all dishwashers.

This testing was preformed in the dishwasher using different size containers.

The data results were interpolated using Newton's interpolation to the forth degree. The larger derivatives were considered negligible when there values were sufficiently low.

$$V_o^{-min}=a2\sqrt{(gz)}$$

Where:
$V_o^{-min}$=The volumetric outflow of fluid from the water-trough

Using Bernoulli's equation $V_o^{-min}$, the mean draining rate of fluid from the container is a function of a2, the size of the draining hole, g, acceleration due to gravity and z, the final height of the fluid.

Considering quasi-static state where the draining of the main cup volume is approximately equal to 0 on a short time period dt.

Considering friction to be negligible. This is the friction associated with sear force at the containers edge and turbulence.

Considering the correction factor for a3, area of the volumetric outflow of fluid to be negligible and therefore a3 to be approximately equal to a2.

The greater time spent at lower z values than higher z values are considered negligible and therefore the change in height is assumed linear with time. This should be a reasonable assumption as $V_i^{-min}>>V_o^{-min}$ ie. The flow into the system is a lot greater then the flow out of the system and therefore the flow out of the system will have a lower influence on the rate of accumulation. Therefore is used within this formula to indicate the mean height of the fluid.

All other influences such as fluid temperature and viscosity were considered negligible.

The reservoir may contain a baffle. This would serve to reduce the movement of water therein; thereby reducing the likelihood of the sensors being submerged and re-emerged due to ripples rather than due to filling/emptying phases of the wash cycle.

The dosing is preferably based upon feedback from a sensor within the device that determines a feature of the load such as the amount of soil thereon and/or a feature of the wash liquor, such as the temperature thereof. In this way a desired chamber in the device may then be activated. At the same time, one or more other chamber(s) may be "locked out", unable to dose its (their) material into the machine.

The sensor may include one or more of the following types of sensor: turbidity sensor, temperature sensor, water/moisture sensor, water hardness sensor, light sensor, conductivity sensor, vibration/sound sensor.

The device may have further sensors (for example of the kind above) which are, whilst associated with the device, distanced there from. For example the device may associate with a relatively remote sensor which is disposed in another part of the machine and/or in a water inlet, water outlet.

In addition or as an alternative the sensors within the machine may be used to detect the type or quality of load or water hardness at the appropriate time. Generally, but not always, this occurs at the beginning of the cycle. Such detection preferably continues throughout the cycle.

For the purposes of the present invention, treating composition (or agent) may mean any suitable chemical formulation for use inside a ware washing machine.

Non-limiting examples include detergent compositions, bleach containing compositions, enzyme containing compositions, rinse aid compositions and water softening compositions.

In certain instances, it may be desirable to dose an enzymatic detergent first, then followed by a hypohalite detergent and then finally with a rinse aid. In other instances, it may be desirable to dose a hypohalite detergent first, then followed by an enzymatic detergent and then finally with a rinse aid. In further instances, it may be desirable to dose an enzymatic detergent first, then followed by a rinse aid; then followed by a hypohalite detergent and then finally with a rinse aid. In still further instances, it may be desirable to dose a hypohalite detergent first, then followed by a rinse aid; then followed by an enzymatic detergent and then finally with a rinse aid. In even still further instances, it may be desirable to first dose water treatment agents (for example, builders, water softeners, chelaters, etc and the like) and then follow with either an enzymatic detergent or hypohalite detergent, then either a hypohalite detergent or enzymatic detergent, and then a rinse aid. Even further instances may include a segment where a dose of anti-lime scale agent is dosed prior to the final rinse aid segment. In even further instances, it may be desirable to dose an additive (for example, a rinse aid) at the same time as the hypohalite detergent or enzymatic detergent. Those in the art will appreciate that there are numerous other segment combinations which can be envisioned, all of which are within the scope of the present invention.

Depending upon the treating agent to be dosed into the machine, the dosing of the detergent may take place prior to the final rinse segment or zone, preferably prior to the first wash segment or zone.

Most preferably the automatic washing machine is an automatic dishwashing machine.

Optionally a plurality of devices may be provided within the automatic dishwashing machine, wherein each device has a plurality of chambers for holding/dosing a treating composition.

Most preferably the chambers of the device contain at least two different treating compositions. Optionally each treating composition differs from each other treating composition.

The treating composition may comprise a single treating agent or compositions, or alternatively may comprise a plurality of treating agents or compositions.

The types of treating agents which can be placed individually into the separate chambers include enzymatic detergents, hypohalite/peroxygen detergents, water treatment agents, rinse aids, anti-lime scale removers, sanitizers, perfumes, and surface repair agents.

By operation of these chambers individually it has been found that the device enables intelligent dosing of detergent compositions (in terms of the total levels and the contents thereof) at various points of a wash cycle in response to the wash conditions being experienced; thereby enabling improved wash performance.

A typical dishwashing cycle consists of a pre-rinse segment, a wash segment, two more rinse segments, and finally, a dry segment. Some dish washing machines may have an additional segment such as treating segments (for example, a water treatment segment or an anti-lime scale segments). A timing device within the dishwasher is responsible for precisely controlling all of the electrical circuits and activating the components associated with each segment.

Preferably the cartridge chamber that is activated in the pre-rinse segment contains an enzymatic detergent and/or surfactants and/or builders.

Preferably the cartridge chambers that are activated in the wash segment independently contain ingredients from the following: a hypohalite/peroxygen detergent, enzymes, surfactants, builders, shine agents.

Preferably the cartridge chamber that is activated in the rinse segment contains a rinse agent.

Preferably the cartridge chamber that is activated in the treatment segment contains an anti-lime agent or a water treatment.

To clearly illustrate this concept the operation of the cartridge in accordance with the method of the present invention in a typical dishwashing machine may be as follows.

For use with a typical multistage dishwashing machine the cartridge comprises four chambers, one for each of the cycles outlined above. Each cartridge chamber, independently of the other cartridge chambers may be filled, partially filled or empty. The filling of each cartridge may be dependent upon the nature of the dishwasher machine cycle, e.g. whether or not a particular segment is present in said cycle. Alternatively the user may exert some influence as to the needs of the items to be washed and the amount of treating composition added to each chamber.

The cartridges may also be sold commercially, wherein the treating agents have been added as necessary to each cartridge chamber.

Usually chamber one (for activation in a pre-rinse segment) contains an enzymatic detergent, chamber two (for activation in a wash-segment) contains a hypohalite detergent, chamber three (for activation in a rinse segment) contains a rinse aid, and chamber four (for activation in a treatment-segment) contains a water treatment agent. Chambers one, two, three, and four are activated during the machine dishwasher cycle in a sequential manner to dose their respective contents (if present) into the machine during a predetermined segment such that only one chamber is activated and the material therein is dosed into the machine during said segment no other chamber is activated and no other material is dosed into the machine until the prior stage has been completed.

Typical pre-programmed cycles found in automatic dishwashing machines and cycles include HEAVY and CHINA CRYSTAL. Within these and other automatic dishwasher cycles, (which can, for example, be selected by the user) is an array of options. Examples of options include DELAY START, AIR DRY, LOW ENERGY RINSE, HIGH TEMP WASH, and CANCEL DRAIN.

Each cycle can have its own treating agent dispense requirements, for example, for a HEAVY cycle, it may be preferred or necessary to first dose a pre-rinse agent then followed by an enzymatic detergent and then the hypohalite detergent (or vice versa) and then finally an anti-lime scale agent.

In another example, for a CHINA CRYSTAL cycle, it may be preferred or necessary to first dose a pre-rinse agent, then an enzymatic detergent (or hypohalite detergent), then the rinse agent, then a hypohalite detergent (or enzymatic detergent), and then finally again a rinse agent.

The skilled person will be readily able to make a selection of the required number and types of treating composition.

For a typical automatic dishwasher machine, once the machine is loaded with articles to be cleaned and/or treated, generally the following events occur when the door of the washing machine is closed and the user has selected a particular cycle (either pre-programmed or programmed).

(1) Latching the door activates the timer and other controls. The user selects a cycle by pressing a button and/or turning a dial on the front panel of the dishwasher.

(2) The timer opens a water-inlet valve and when the water reaches the appropriate level in the dishwasher tub, the water-inlet valve closes. The timer advances to activate a motor-driven pump, which sends water through the pump housing and into the spray arms and tower at a powerful rate, causing the spray arms to rotate and spray water over the dishes.

(3) As the water becomes soiled with food particles, the water circulates through a filtration system which eliminates food particles from the water.

(4) At the end of the rinse segment, the timer signals the machine to empty the water into the home's drain system. If a cycle requires another rinse segment, the timer activates the machine to refill, rinse and drain before going into the main wash segment.

(5) For the main wash segment, the timer signals the detergent dispenser to open and empty its contents into the water-filled tub.

(6) The hot water and detergent are pumped throughout the machine to break down and loosen soil on dishes and utensils. The timer then directs the pump to drain the tub and refill with clean, hot water for final rinse segments.

(7) Once the final rinse segments are completed, the automatic drying period begins.

As can be appreciated, at certain points within the above cycles, the treating agents discussed herein can be dosed into the washing machine to perform rinsing, cleaning, disinfecting, water treating, and other tasks for which the treating agents are designed.

For example, during segment (2), a water treatment agent could be dosed into the washing machine to address any water hardness issues. Of course this will vary depending upon the water quality of the individual user. Thereafter, a rinse agent could also be dosed.

For segment (5), an enzymatic detergent could be dosed first into the washing machine and allowed to work. Then a segment (5A) could be envisioned where there is a short rinse and then segment (5B) would then dose a hypohalite detergent. Then segment (6) would then follow.

As mentioned above, there can be a variety of different segments which can be placed in a variety of sequences to define a cycle. The various cycles can be pre-programmed by the washing machine manufacturer or could be programmed by the user. Also envisioned are sensors within the washing machine that could sense the article load and the soil load. In so doing, the amount of treating agent to be dosed could be changed to meet the load requirements.

In practice, the washing machine user will load the washing machine with articles to be cleaned. After selecting a pre-programmed cycle or selecting segments which form a cycle, the washing machine is turned on.

Water hardness sensors can be used. The water hardness sensor could be an ion selective electrode or detectors which can measure the amount of calcium and/or magnesium in the water. The sensor can be preset such that depending upon the hardness of the water, an appropriate amount of water treating agent can be added. Water hardness is classified by the U.S. Department of Interior and the Water Quality Association and can range from soft water (0-17 mg/l or ppm of hardness) to moderately hard water (60-120 mg/l or ppm of hardness) to hard water (120-180 mg/l or ppm of hardness) to very hard water (>180 mg/l or ppm of hardness). The amount of water treatment agent needed to be added to adjust the incoming water to an appropriate water hardness can be programmed into the sensor. Additionally, various types of water treatment agents are available and the sensor can be programmed to identify the water treatment agents in the cartridge through manufacturer's sensors identifying the agents which are placed on a cartridge.

Once the water hardness has been adjusted to an appropriate level, infrared and/or ultra violet sensors which are placed within the washing machine can do a survey of the load to determine the type and quantity of load. For example, the IR and/or UV sensors could send out signals to survey the load. Both enzyme sensitive and hard to remove stains, as discussed above, could be detected. If the majority of the stains were detected to be hard to remove stains, for example, red containing stains which could be indicative of a tomato based stain—identified above as preferably treated by the use of a hypohalite detergent. If detected, then a logic switch connected to the sensor would then send a signal to the chamber containing the hypohalite to be dispensed and thus a first wash segment could be commenced. Thereafter, once this wash segment was complete, the water in the cavity could be discharged, new water loaded, again check for water hardness, and then the enzymatic detergent could be charged into the machine and the second wash segment could commence. Once this wash segment was complete, the water in the cavity could be removed and the rinse segment(s) could commence.

Those in the art will appreciate that if the IR and/or UV sensors detected more protein type stains (for example, egg), then the first wash segment would be conducted using an amount of enzymatic detergent dosed into the cavity. The second wash segment would then be conducted using the hypohalite detergent.

The invention claimed is:

1. A method of dispensing a plurality of treating compositions into a multistage automatic washing machine comprising:

providing a device inside a multistage automatic washing machine, the device comprising at least two chambers, each chamber containing a compositionally different treating composition, the device further comprising a wash liquor reservoir associated with the chambers, the wash liquor reservoir having a wash liquor inlet, a separate wash liquor outlet through which the wash liquor can drain continuously, and a wash liquor sensor disposed within the reservoir;

operating the automatic washing machine to create wash liquor in the interior of the machine;

collecting a sample of the wash liquor in the wash liquor reservoir by allowing the sample to travel from the interior of the machine through the wash liquor inlet and into the reservoir, while allowing the collected wash liquor to drain continuously from the wash liquor reservoir through the separate wash liquor outlet and back into the interior of the machine; and activating the chambers to release the treating compositions at different times in response to inputs from the wash liquor sensor.

2. The method according to claim 1 further comprising providing a plurality of devices within the automatic washing machine.

3. The method according to claim 1, wherein the device comprises at least 7 chambers.

4. The method according to claim 3, wherein the device comprises a chamber suitable for activation in a pre-rinse segment, which contains an enzymatic detergent treating composition.

5. The method according to claim 3, wherein the device comprises a chamber suitable for activation in one of a wash and rinse segment, which contains a hypohalite/peroxygen detergent treating composition.

6. The method according to claim 3, wherein the device comprises a chamber suitable for activation in one of a wash and rinse segment, which contains a rinse agent treating composition.

7. The method according to claim 3, wherein the device comprises a chamber suitable for activation in a treatment segment, which contains one of an anti-lime agent and a water treatment agent treating composition.

8. The method according to claim 1, wherein in operation the device interacts with a further sensor within the automatic washing machine, the further sensor sensing a parameter of the automatic washing machine wash liquor and conveying the parameter back to the device, influencing the operation of a device chamber.

9. The method according to claim 8, wherein the further sensor senses the turbidity of the automatic washing machine wash liquor.

10. The method according to claim 8, wherein the further sensor senses the temperature of the wash liquor in the automatic washing machine.

11. The method according to claim 8, wherein the cartridge sensor senses the presence of water within the automatic washing machine.

12. The method according to claim 1, wherein the automatic washing machine is an automatic dishwashing machine.

13. The method according to claim 1, wherein the reservoir includes a baffle.

14. The method according to claim 1, wherein the reservoir is covered by a gauze.

15. A method of automatic dishwashing in an automatic dishwashing machine comprising:

providing an automatic dishwashing machine inside which is located a device which comprises a first chamber containing a first bleach-containing treating composition, and a second, separate, chamber containing a second enzyme-containing treating composition which is different to the first treating composition, wherein the device further comprises a reservoir for collection of wash liquor and one or more sensors able to monitor wash liquor in the reservoir, and wherein the reservoir has a water inlet and a separate draining hole as an outlet;

collecting wash liquor, which has been created inside the dishwashing machine, in the reservoir and allowing the wash liquor that has been collected to drain continuously through the outlet and back into the interior of the machine; and dosing the first and second treating compositions into the interior of the machine, at different times to each other during one complete wash cycle of the machine, and in response to water conditions sensed by the one or more sensors.

16. The method according to claim 15, wherein the one or more sensors are independently selected from the group consisting of a turbidity sensor, a temperature sensor, a water sensor, a moisture sensor, a water hardness sensor, a light sensor, a conductivity sensor, a vibration sensor and a sound sensor.

17. The method according to claim 15, wherein wash liquor drains from the reservoir in less than 1 minute during the wash cycle.

* * * * *